US009958217B1

(12) United States Patent
Oakes et al.

(10) Patent No.: US 9,958,217 B1
(45) Date of Patent: May 1, 2018

(54) BAFFLE SYSTEM AND METHOD FOR A HEAT EXCHANGER LOCATED WITHIN A CASING OF A HEAT RECOVERY STEAM GENERATOR

(71) Applicant: Nooter/Eriksen, Inc., Fenton, MO (US)

(72) Inventors: Lawrence Oakes, Pueblo, CO (US); Daniel C. Osbourne, Fenton, MO (US)

(73) Assignee: NOOTER/ERIKSEN, INC., Fenton, MO (US)

( * ) Notice: Subject to any disclaimer, the term of this patent is extended or adjusted under 35 U.S.C. 154(b) by 701 days.

(21) Appl. No.: 14/304,248

(22) Filed: Jun. 13, 2014

Related U.S. Application Data

(60) Provisional application No. 61/837,104, filed on Jun. 19, 2013.

(51) Int. Cl.
*F28F 9/00* (2006.01)
*B23P 15/26* (2006.01)
(Continued)

(52) U.S. Cl.
CPC ..... *F28F 9/005* (2013.01); *B23P 15/26* (2013.01); *F28F 9/001* (2013.01); *F28F 9/002* (2013.01);
(Continued)

(58) Field of Classification Search
CPC .. F28F 9/001; F28F 9/002; F28F 9/005; F28F 9/0131; F28F 9/22; F28F 9/0075;
(Continued)

(56) References Cited

U.S. PATENT DOCUMENTS 1,689,910 A * 10/1928 Brocklebank ..... F28F 9/22 165/78
2,670,183 A * 2/1954 Hammond ..... F28D 19/047 165/9
2016/0290742 A1* 10/2016 Okimoto ..... F28F 9/22

FOREIGN PATENT DOCUMENTS

DE 4344257 A1 * 6/1994 ..... F22B 1/025
FR 2707373 A1 * 1/1995 ..... F22B 37/205
(Continued)

OTHER PUBLICATIONS

Reference is made to the subject U.S. Appl. No. 14/304/248 and its section entitled "Background of the invention" on pp. 2-4. The drawing submitted herewith illustrates such attachment of the angle iron to a liner by welding. As noted in paragraph No. 4, a heat recovery steam generator ("HRSH") includes a casing having an inlet and an outlet and a succession of heat exchangers. Paragraph No. 6 remarks that the heat exchangers include coils having tubes usually oriented vertically and arranged in rows across essentially the entire width of the casing.

*Primary Examiner* — Devon Russell
(74) *Attorney, Agent, or Firm* — Sandberg Phoenix & Von Gontard, P.C.

(57) ABSTRACT

Disclosed is: A casing of a heat recovery steam generator has a sidewall, and heat exchanger coil located therein capable of exchanging heat from hot exhaust gas flow into the casing, with a gap between the end of the coil and a sidewall. A baffle system for closing the gap after the coil is installed in the casing comprises a mount attached to the coil near the gap, and a baffle plate associated with the mount and movably supported thereby. The configuration of the mount and baffle plate are such to allow the baffle plate to be capable of moving from a retracted position withdrawn from the sidewall, to an extended position closing the gap. A retainer can hold the plate in the retracted position. The retainer can release, for example, by being temperature sensitive. The mount can have a support that engages the coil.

17 Claims, 7 Drawing Sheets

(51) Int. Cl.

| | |
|---|---|
| ***F28F 9/007*** | (2006.01) |
| ***F28F 11/06*** | (2006.01) |
| ***F28F 9/013*** | (2006.01) |
| *F28F 9/22* | (2006.01) |

(52) U.S. Cl.
CPC ..... *F28F 9/0075* (2013.01); *F28F 9/0131* (2013.01); *F28F 11/06* (2013.01); *F28F 2009/226* (2013.01)

(58) Field of Classification Search
CPC .. F28F 2009/226; F28F 11/06; F28F 2235/00; F28F 2275/08; F28F 2220/00; F28F 2230/00; F28F 2280/10
USPC ..... 165/76, 78, 79, 159
See application file for complete search history.

(56) References Cited

FOREIGN PATENT DOCUMENTS

| | | | | | |
|---|---|---|---|---|---|
| FR | 2726354 | A1 | * | 5/1996 | ..... F24H 1/142 |
| JP | 59164893 | A | * | 9/1984 | ..... F28F 9/005 |
| JP | 08075386 | A | * | 3/1996 | ..... F28F 9/005 |
| JP | 2004301479 | A | * | 10/2004 | ..... F28D 21/0003 |
| SU | 1402790 | A | * | 1/1989 | |

* cited by examiner

BAFFLE SYSTEM AND METHOD FOR A HEAT EXCHANGER LOCATED WITHIN A CASING OF A HEAT RECOVERY STEAM GENERATOR

CROSS-REFERENCE TO RELATED APPLICATIONS

This application claims priority to U.S. Provisional Patent Application No. 61/837,104, filed on Jun. 19, 2013, with named inventors Lawrence Oakes and Daniel C. Osbourne, the disclosure of which is incorporated herein by reference in its entirety.

STATEMENT REGARDING FEDERALLY SPONSORED RESEARCH

Not Applicable.

BACKGROUND OF THE INVENTION

Natural gas serves as the energy source for much of the currently generated electricity. To this end, the gas undergoes combustion in a gas turbine which powers an electrical generator. However, the products of combustion leave the gas turbine as an exhaust gas quite high in temperature. In other words, the exhaust gas represents an energy source itself. This energy is captured in a heat recovery steam generator ("HRSG") that produces superheated steam that powers another electrical generator.

An HRSG in its most basic form includes a casing having an inlet and an outlet and a succession of heat exchangers—namely a superheater, an evaporator, and a feedwater heater arranged in that order within the casing between the inlet and outlet. Subcooled water enters the HRSG at the feedwater heater which elevates its temperature. The warmer water from the feedwater heater flows into the evaporator where it is converted into saturated steam. That steam flows on to the superheater which converts it into superheated steam, and, of course, the superheated steam enters the steam turbine.

Each heat exchanger includes coils, having tubes, usually oriented vertically and arranged in rows across essentially the entire width of the casing. To be sure, the coils must be somewhat narrower than the spacing between the liners that form the inside surfaces of the sidewalls of the casing, this in order to facilitate installation of the coils in the casing. In this regard, the coils are typically lowered through the roof of the casing to the floor of the casing, whereupon they are secured in the casing. Owing to the side clearances required for the installation, gaps exist between the endmost tubes of the coils and the liners along the sidewalls of the casing. Unless these gaps are obstructed, some of the exhaust gas flowing through the casing will simply bypass the coils, or in other words, flow past the sides of the coils instead of through the coils. The exhaust gas that bypasses does not transfer its energy to the water in the coils, whatever phase that water may be.

Typically, once a coil is lowered into its position within a casing, the gaps to the sides of it are closed with baffles which are formed from steel angle iron. Traditionally, sidewall gas baffles are constructed of ¼ in.×2 in.×2 in. steel angle iron. They are welded to the liner plates after the coil modules are installed through the roof of the casing. One flange of each baffle lies against the sidewall liner at the gap, while the other flange projects toward the coil and closes the gap.

Hence, such sidewall gas baffles in an HRSG extend from top to bottom on the left and right side of the heat transfer coils where they butt up against the inside liner. Their purpose is to prevent exhaust gases from taking a shortcut between the heat transfer coil and the liner wall. Thus, eliminating the exhaust gas flow shortcut of bypassing the coil increases the heat exchange performance of the HRSG.

But installing a traditional angle iron baffle is a time-consuming procedure. A contractor normally needs to erect scaffolding between the coil modules to have a platform in which to weld these angle baffles. Hence, it requires workers to enter the casing, erect scaffolding, and weld the angles to the liners, with much of the work being conducted from the scaffolding.

These baffles are installed separately in the field because the tolerances in the construction of the HRSG are too tight to prefabricate these angle baffles either on the coil or on the liner, and ensure that the coils can be lowered in from the roof without inflicting damage.

An advantage of this inventive system and method is that the sidewall gas baffle can be installed onto the coil module in the shop. A mount is positioned on the coils. The baffle is supported by the mount. The baffle is retained in a first position relative to the mount and coil by a retainer. The retainer can be released so that the weight of the baffle will cause the baffle to slide down and outward to a second position, bridging the construction tolerance gap to block bypass of the exhaust gap in an HRSG. In a preferred embodiment, during construction, and installation of the coil modules, the baffle is held in the first position by ties. These ties will melt at operating temperatures of the HRSG. When the baffles are so held, such as by ties, in the first position, they fit within the profile of the coil module, allowing the coil to be dropped in through the casing, as is normally done.

The foregoing and other features and advantages of the invention as well as presently preferred embodiments thereof will become more apparent from the reading of the following description in connection with the accompanying drawings.

DESCRIPTION OF DRAWINGS

Corresponding reference numerals indicate corresponding parts throughout the several figures of the drawings.

DISCLOSURE OF MODES OF SYSTEM AND METHOD, INCLUDING KNOWN BEST MODE

Figure 1:
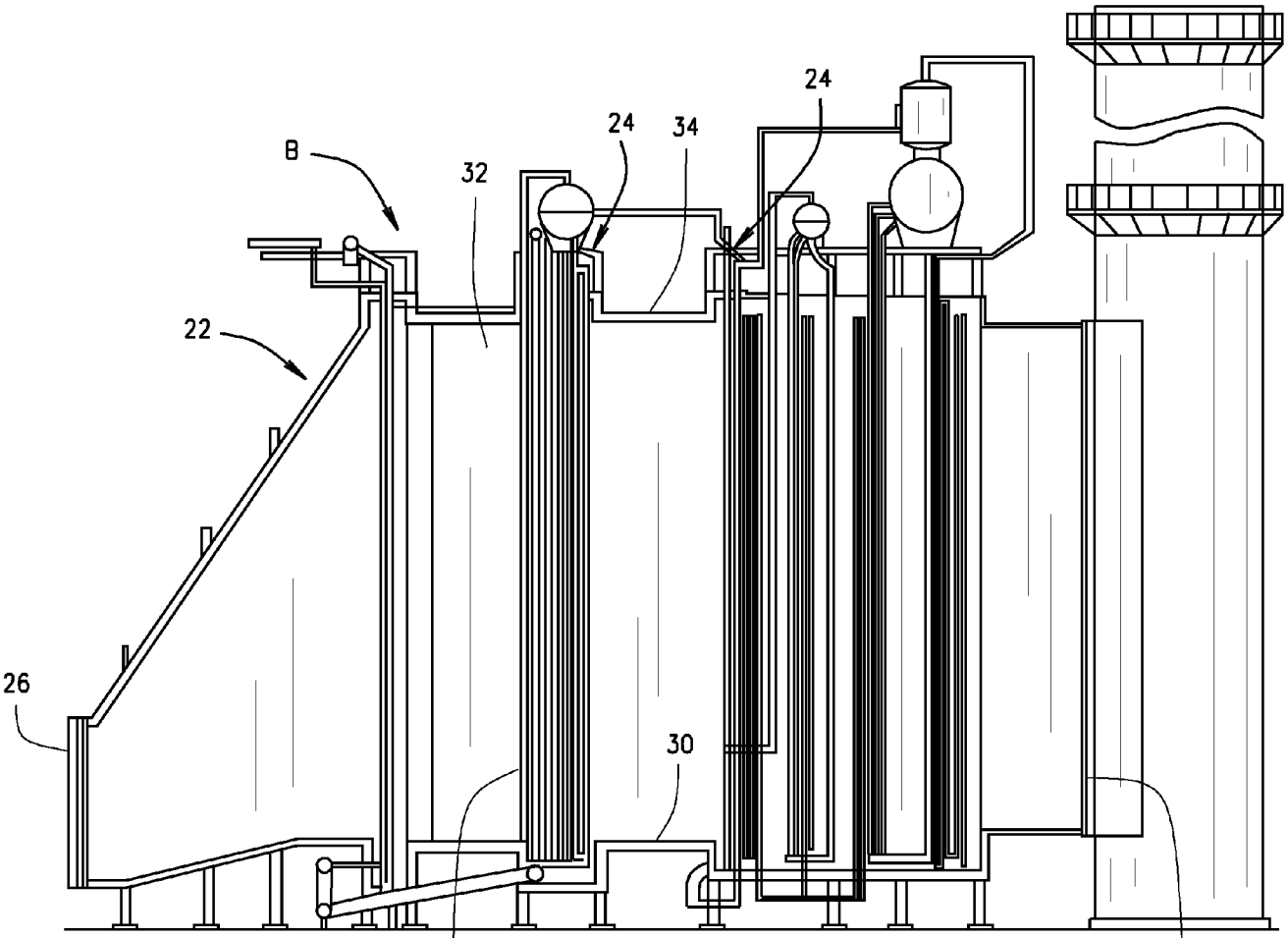
FIG. 1 is a schematic view of a heat recovery steam generator ("HRSG")

The following detailed description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

The present invention resides in a baffle system A and method for use in an HRSG B. As seen in the schematic of FIG. 1, generally an HRSG B includes a casing 22 and a succession of coils 24, which are actually heat exchangers, located within the casing 22. Hot gases, typically the discharge from a gas turbine, enter the casing 22 at an inlet 26 and leave through an outlet 28. In so doing they pass through the heat exchangers or coils 24.

The casing 22 has a floor 30 over which the coils 24 are supported, and sidewalls 32 that extend upwardly from the floor 30. The top of the casing 22 is closed by a roof 34, which like the floor 30, extends between the sidewalls 32. The roof 34 contains panels, some of which can be attached to the coils 24, so that when the coils are installed the panels are in place to form the roof 34. The sidewalls 32 typically have on the exterior a thicker stainless steel wall 33 then to the interior of that an adjacent layer of insulation 35. A liner 36 is located adjacent the interior surface of the insulation. Liner 36 can typically be 16 gauge steel sheet, and serves as the inside of the sidewall 32.

Figure 2:
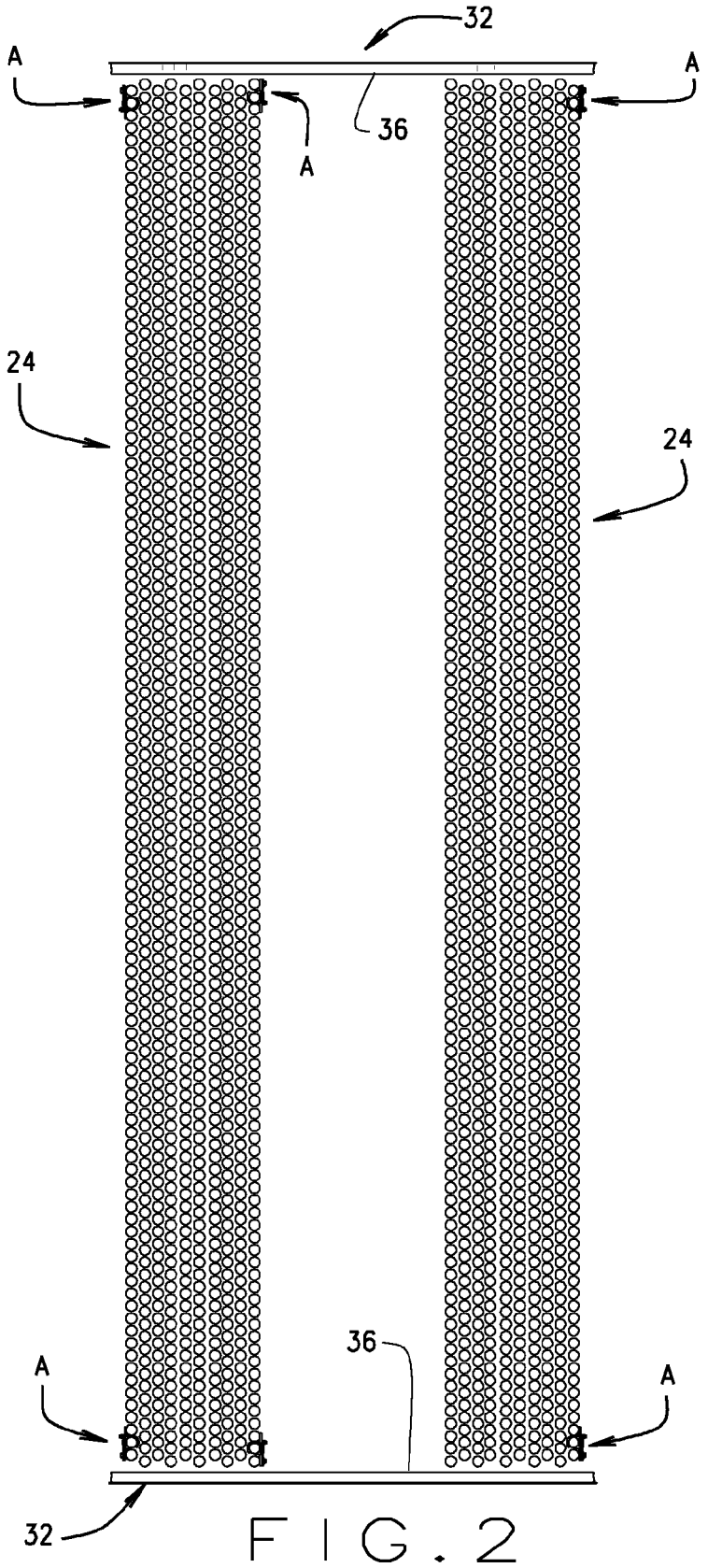
FIG. 2 is a top sectional view of a part of an HRSG showing multiple baffle systems "A" mounted to heat exchange coils.

Each coil 24 has a multitude of tubes 40 oriented vertically and arranged one after the other transversely across the interior of the casing 22, and also in rows located one after the other in the direction of the hot gas flow depicted by the arrow in FIG. 2. The tubes 40 contain water in whatever phase its coil 24 is designed to accommodate. The tubes 40 preferably comprise fins 42 to enhance heat exchange with the hot gas that flows about the tubes 40 and their fins 42. Generally, the fins 42 can be of a spiral configuration that winds about the length of the tubes. The fins 42 can be segmented, or have teeth, or can be solid. The fins typically can be from ¼ in. to ¾ in. in length. The spiral layers of fins can vary in compactness from about one to seven per inch of tubing.

Figure 5:
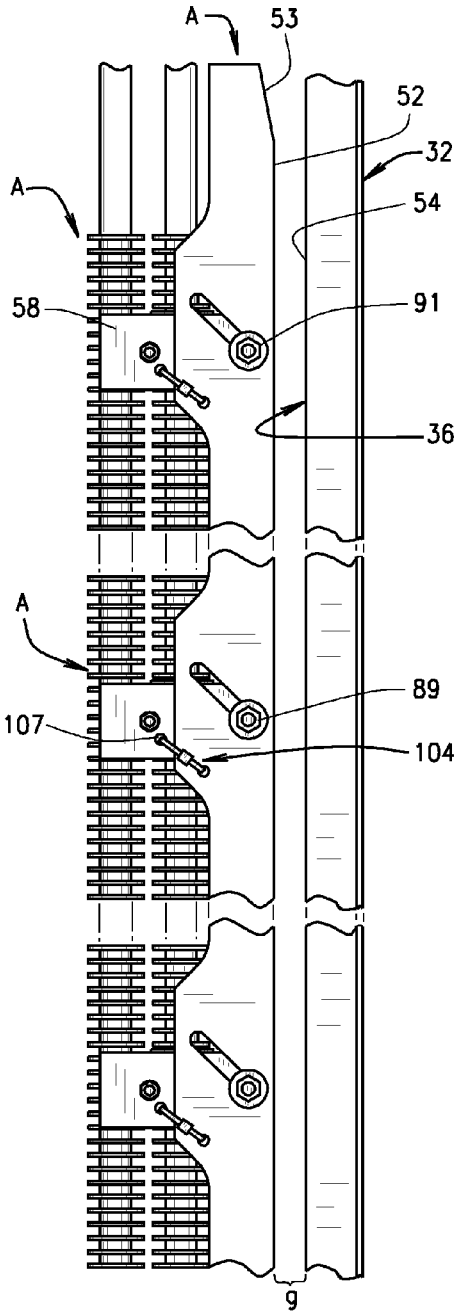
FIG. 5 is an elevated view of a section of a baffle system and a side wall of an HRSG, with some parts shown broken, with the baffle system in a retracted or compressed position relative to the heat exchange coils.

The length of the tubes 40 can be as great as 80' tall. There can be gaps in the locations along the tubes where fins 42 are absent. Anti-vibration braces can extend transversely across the tubes 40 in the areas where the fins 42 are absent, to dampen vibration and resist adverse effects of resonance. Multiple sets of baffle plate arrangements can be placed along the coil 24 between the anti-vibration braces. The baffle plates 52 can have their ends sloped as shown at 53 at the top of FIGS. 5 and 6 to facilitate handling thereof, and also in the case of the lower end of the baffle plates 52, to assist in the inserting the coils 24 with the baffle assemblies "A" mounted thereto.

The hot gas passes over the exterior surfaces of the tubes 40 and their fins 42. The tubes 40 are fixed rigidly in position within their coils 24. The endmost tubes 40 on each coil 24 also preferably have fins 42, and are spaced from the liners 36 on the sidewalls 32 of the casing 22, to leave gaps "g" between the outer edge of the fins 42 and the inner surface of the liners 36. Unless the gaps g are obstructed, hot gas will flow through them, and thus the energy within that gas will not effectively transfer to the water in the tubes 40.

The baffle systems A close the gaps g. From a general standpoint, each baffle system A has mounting structure 48 (generally referred to as a mount 48), which attaches to a coil 24. Each baffle system A also has a baffle plate 50. The mount 48 and baffle plate 50 are configured so that they can be connected to each other in a first position in which the baffle plate 50 is mounted relative to the mount 48 in a retracted or compressed arrangement, shown in FIG. 5. In this first contracted position, the system A features a retainer that holds the baffle plate 50 to the mount 48 in this first compressed position. The configurations of the mount 48 and baffle 50 are such that when the retainer restraining force is absent, the force of gravity acts upon the baffle plate 50 to move it to an extended position shown in FIG. 6, so that its outer edge 52 contacts the inner surface 54 of the sidewall liner 36 to close the gap g, to thus block the flow of hot gas through the gap g.

More Specific Disclosure of Modes, Including Best Mode

Figure 15:
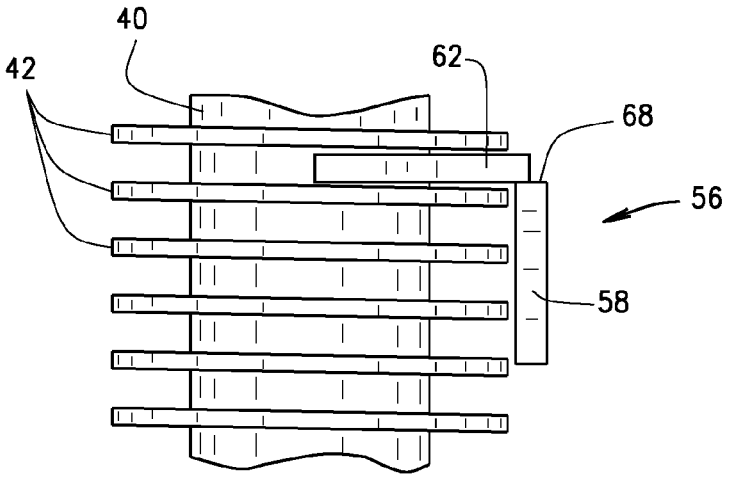
FIG. 15 is an elevated view of a coil tube and its fins, with the tube shown broken and with the support plate of the bracket to the right, with an interface plate of the type shown in FIGS. 3, 4 and 8 extending to be engaged between a pair of fins and resting on top of the fin beneath it.

Turning now to a more specific discussion of an embodiment of the disclosure, the mount 48 of a baffle system A can include a bracket 56. As seen more clearly in FIGS. 3, 4, and 15 the bracket 56 can include a support plate 58 which has an interior surface 59. The mount bracket 56 can be provided with structure shaped to conform to the shape of a tube 40 and any fin 42 structure on tube 40. Toward that end, bracket 56 is provided with a tube interface plate (or clip plate) 62, which has a generally straight proximate edge 65. A side of interface plate 62 can be secured to a longitudinal edge 68 of the support plate 58, as by welding. The interface plate 62 extends generally perpendicular to plate 58. The outer distal part of the tube interface plate 62 has a generally semicircular notch 71. Part of the interface plate 62 that is adjacent notch 71 fits to engage a fin 42 to rest upon it to resist vertical movement of plate 58 upwardly and downwardly, and to resist lateral movement of plate 58 relative to the tubes 40 and the fins 42.

Figure 4:
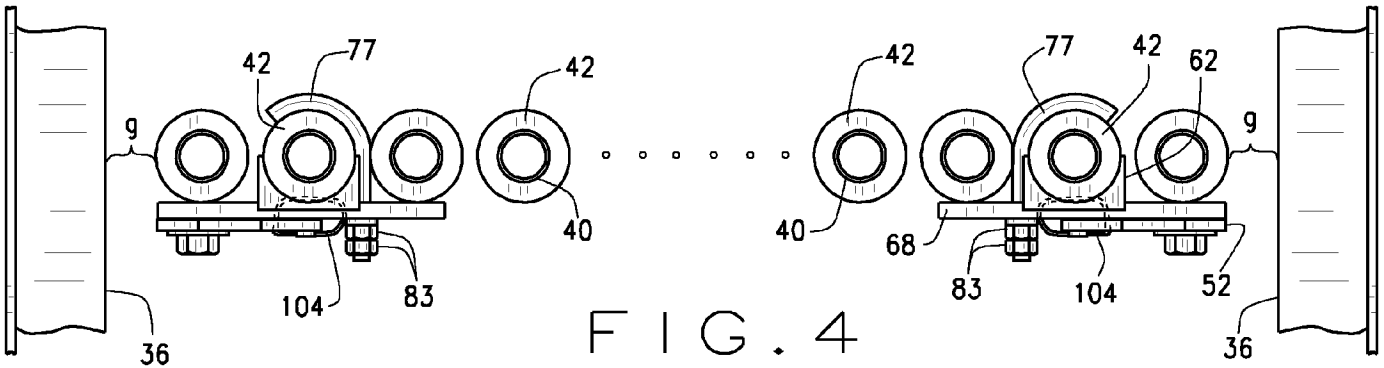
FIG. 4 is top view showing a pair of mounts secured relative to a heat exchange coil, and a baffle plate associated with each mount, with sidewalls of an HRSG shown broken and to the outside of each mount.

A grip member such as a J-shaped bolt 74 secures the plate 58 against adjacent tubes 40. As seen in FIG. 4, the hooked segment 77 of the bolt 74, which is shown as being curved, fits behind the fins 42 of one of the tubes 40, whereas the shank 79 of the bolt 74 passes between two of the tubes 40 and through the support plate 58. Here the shank 79 has threads about which a washer 81 extends, and with which a pair of nuts 83 are engaged. The nuts 83 are turned down against the plate 58 and washer 81 to secure the bracket 56 and J-bolt 74 in a fixed position against the fins 42 and tube 40 about which they extend. The J-bolt shank 79 fits snugly against the tube fins 42 through which it extends.

Figure 3:
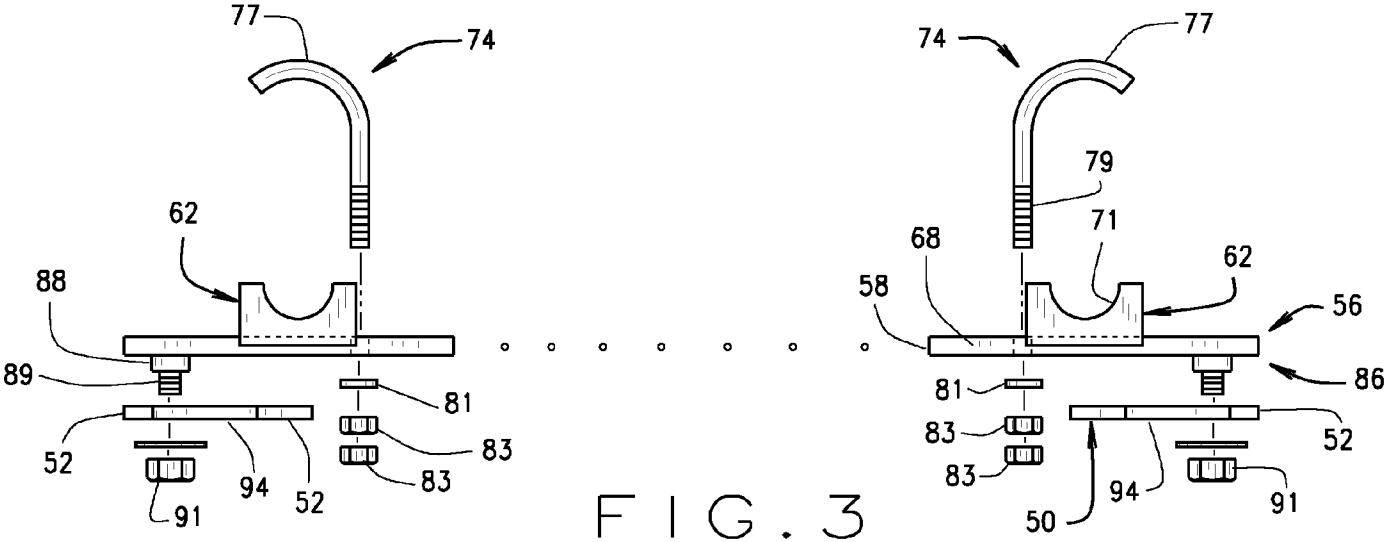
FIG. 3 shows exploded views of components of two mounts for attaching to a heat exchanger coil, and a baffle plate supported by each mount.

In addition, the bracket 56 has a pin 86. As seen in FIG. 3, pin 86 has an enlarged proximal cylindrical section 88, part of which is received within a bore of plate 58 and plug welded thereto to be held securely thereto. The outside of the plug weld can be ground smooth to be flush with the surface of plate 58. The pins 86 projects generally perpendicular from the plate 58. Part of the enlarged section 88 extends beyond the surface of plate 58 on the opposite side from the J-bolt hook 77, and is received within a baffle slot to be described. From the enlarged section 88, pin 86 extends into a smaller cylindrical section 89 that is threaded, and about which a washer extends and over which a nut 91 is threaded. When located within the casing 22, the pin 86 extends generally parallel to the liner 36 of the sidewall 32. Several mounts 48 are attached to the tubes 40 at the gap g.

The length of the large pin section 88 is such that when nut 91 is tightened there is sufficient room to allow baffle 50 to slide freely. Preferably the length of the large pin section 88 is such that it extends beyond the surface of plate 58 about ⅛ in.

It is preferable that the interior surface 59 of the support plate 58 facing the tube fins 42 be in contact with the fins 42 for all three of the tubes 40 shown adjacent plate 58 in FIG. 4 to stabilize the plate 52 with tubes 40 and their fins 42, and to better prevent misalignment that might occur if the plate 58 were only contacting two of the tubes 40 and their fins 42. Such alignment of support plate 58 helps orient the baffle plate 50 towards perpendicular movement toward the liner 36, so that the baffle plate 52 will, when it engages the liner 36, be approximately perpendicular thereto.

As noted earlier, each baffle system assembly "A" further includes a baffle plate 50. Baffle plate 50 is preferably generally flat, and preferably extends vertically for essentially the full height of the gap g. The baffle plate 50 lies over the support plates 58 of the several brackets 56, and preferably lies in a plane that is generally perpendicular to the liner 36 on the sidewall 32. In its position relative to the bracket 56, the baffle plate 50 has a slot 94 that loosely receives the enlarged section 88 of pin 86 of a bracket 56, so that the pin section 88 can slide through slot 94, but still be retained within the slot 94. The slots 94 of the baffle plates 50 are parallel and oblique. Preferably they are oriented at about 45° to the vertical. The slots 94 enable the baffle plate 50 to move between the aforesaid retracted position of FIG. 5, wherein a working clearance exists between the outward edge 52 of the plate 50 and the inner surface 54 of liner 36, and the aforementioned extended position of FIG. 6, wherein the outer edge 52 of the plate 50 is in contact with the inner liner surface 54. In the latter position, the baffle plate 50 extends across the gap g to close and block the gap g and block flow of the hot gas there through.

As discussed above, initially, the baffle assembly A includes a retainer that holds the baffle plate in the first compressed position. An example of such a retainer is illustrated as a temperature sensitive releasable retaining device, shown in the form of a tie 104 that loops around one of the endmost tubes 40, through a hole 107 in the support plate 58, and through a hole 109 in baffle plate 50. As such, tie 104 holds the baffle plate 50 in its retracted position of FIG. 5—a position in which the thicker section 88 of pins 86 are preferably in the lower ends of their slots 94. The material from which the tie 104 is made will fail or disintegrate at a temperature less than the temperature of the hot gas passing through the coil 24. The characteristics are thus based on the thermodynamics of the operating conditions of the HRSG in which they are placed. Plastic ties used to bundle electrical wires are suitable for the ties 104. Under certain operating conditions suitable ties are Gardner Bender brand 14" long with 75 lbs. tensile strength rating and 185° F. rating, Part No. 45-314UVL, Gardner Bender (gardnerbender.com), Milwaukee, Wis.; a company of Actuant Corporation, 13000 West Silver Spring Drive, Butler, Wis. 53007. The ties should not be excessively strong as they will not fail when desired. Preferably the ties 104 under operating conditions that are typical should not exceed a rating of 75 lbs. and will melt at a temperature in excess of 185° F., though failure at lower temperatures above normal ambient temperatures is also within the scope of this disclosure. For example, failure at lower temperatures such as about 150° F. would be operable. The ties should fail at what would be normal operating temperatures for the hot gas that is flowing by the ties in the particular location of the HRSG. The ties could be made of other materials, such as metal, with performance parameters such as discussed for plastic ties.

Figure 7:
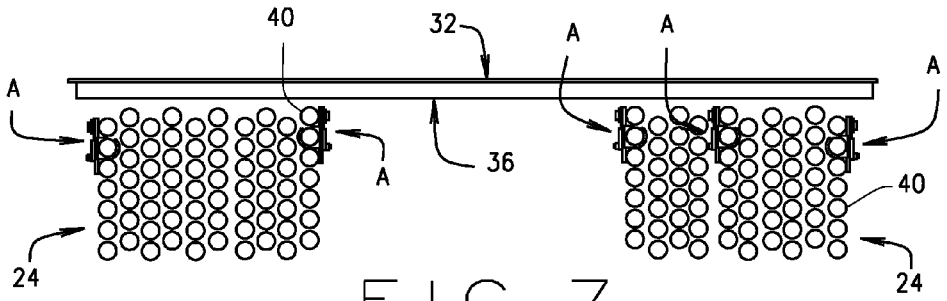
FIG. 7 is a top sectional view of a part of an HRSG showing a modification from FIG. 2 of the location of multiple baffle systems "A" mounted to heat exchange coils.

As seen in FIG. 2, baffle assemblies can be placed at different positions relative to a coil 24. In a modification shown in FIG. 7, the coil 24 shown to the right has a baffle assembly "A" located at each of the corners, and a baffle assembly "A" located adjacent three coils toward the middle of the two corner baffle assemblies "A".

Though considered to be less preferable than the disclosed heat-sensitive ties, as an alternative, explosive or pyrotechnic ties, bolts, or cable cutters, each of which could be triggered electronically via remote control, could be used.

During construction of the HRSG B, the coil 24 is lowered through the roof 34 of the casing 22 with the baffle plates 50 of its baffle systems A in their retracted positions. Thereupon the coil 24 is secured in position within the casing 22 and the roof 34 is closed. The baffle system "A" is then in the retracted position of FIG. 5. Once, the HRSG is set in operation, the ties 104 on the baffle systems A fail as a result of the hot gas heating them and weakening them, and the force of gravity acts against the baffle plates 50 to force the plates 50 to drop downwardly. Owing to the oblique orientation to the slots 94, the pins 86 slide downwardly and outwardly through the slots 94, so that the baffle plates 50 move outwardly away from the endmost tubes 40 of the coil 24 and toward the liners 36 on the sidewalls 32. The vertical outer baffle plates edges 52 seat against the liners 36 of the sidewalls 32, as shown in FIG. 6, and thus the baffle plates 50 close the gaps g and substantially block the flow of hot gas through the gaps g.

Figure 6:
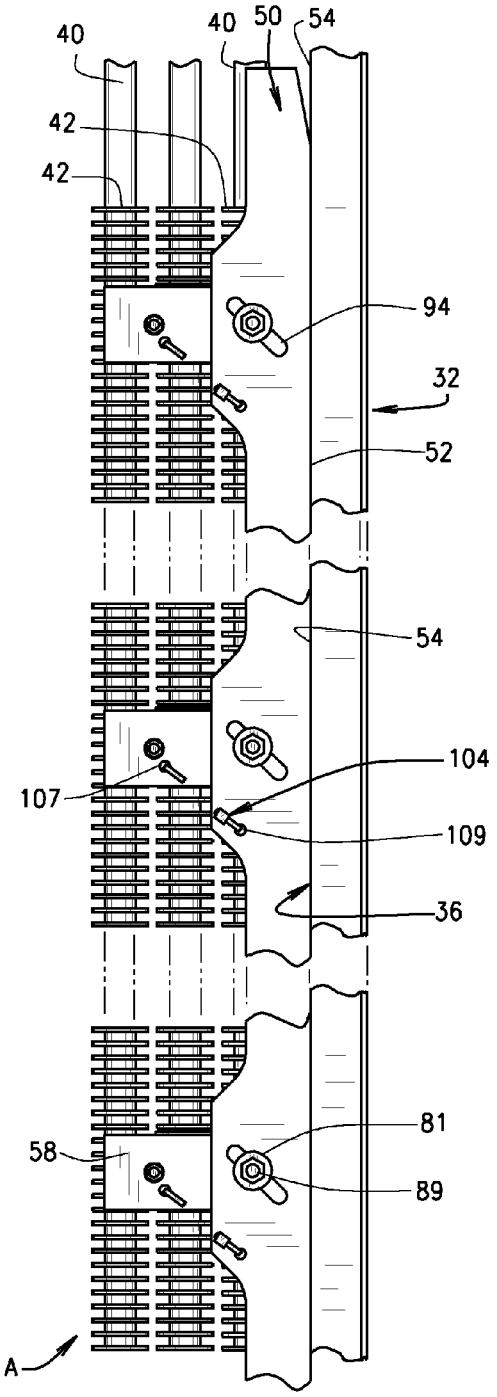
FIG. 6 is an elevation view of a section of a baffle system and a side wall of an HRSG, with some parts shown broken, with the baffle system in an extended position in which the outer edge of the baffle plate is in contact with the inner surface of the sidewall liner to close the tolerance gap to thus block air flow about the outer edges of the heat exchange coils.

As shown in FIG. 6, when the outer edge 52 of baffle plate 50 abuts the sidewall liner 36, the slide pin enlarged section 88 is spaced from the upper end of slot 94. Thus pin 86 section 88 has not traveled the full length of the slot 94 when the baffle plate 50 moves from the position of FIG. 5 to FIG. 6, and pin section 88 does not jar against the upper edge of slot 94 when it slides or when the baffle plate 50 movement stops. By giving a cushion of extra length for the slot 94, the baffle plate system and method has a built-in flexibility to enhance the ability of the baffle plate 50 to travel smoothly during its sliding outwardly and downwardly to close the gap g, and also to allow leeway for tolerances in installing the coil 24 into the HRSG B.

In a preferred embodiment, the baffle plate 50 can be about ¼ in. thick; the support 58 about ⅜ in. thick by about 7 in. long and about 3 in. wide; the interface plate 62 about ⅛ in. thick by about 2½ in. long by about 1 5/16 in. wide; the pin 86 diameter about ⅝ in. for the thicker portion 88 and about ⅜ in. diameter at its narrower portion 89; and the J-bolt diameter about ⅜ in. The height of the baffle plate is dependent on the height of the interior in the location of the HRSG casing in which the particular coil and baffle assemblies "A" are located. In an embodiment in which the baffle plate height is about 13 feet, 1 in., there can be four baffle systems A, with the two interior systems A spaced about 3 ft. 11 in. apart from each other, and each of the outer baffle systems A spaced about 3 ft., 10 in. apart from its adjacent interior baffle system A.

Figure 8:
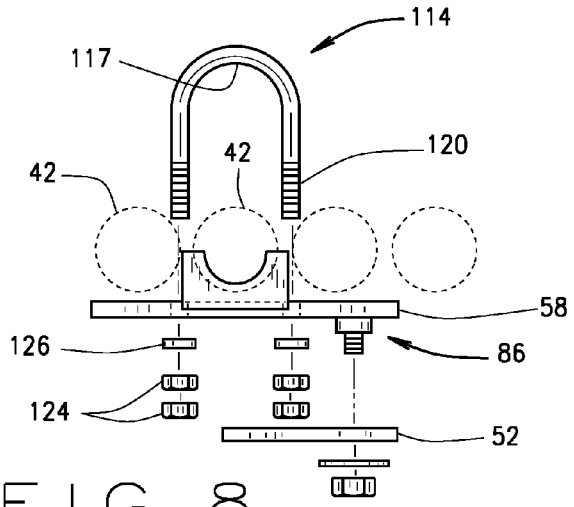
FIG. 8 is a modification of a baffle assembly showing a U-bolt arrangement for extending about a coil tube and extending through a support plate.

Various alternatives can be provided regarding the foregoing disclosure. In addition to those previously mentioned, as further example, rather than using the J-shaped bolt 74, as shown in FIG. 8, the grip member 74 can comprise U-shaped bolts 114, with the bite 117 of the U-bolt 114 fitting against the outer contours of the fins 42 on tube 40. The shaft on each leg 120 of the U-bolt would extend through bores in support plate 58, so that the threaded ends of those shanks are secured by nuts 124 and washers 126 on the opposite side of plate 58. Each U-bolt leg 120 thus extends between the space between the tube 40 and its fins 42 about which the U-bolt loops, to fit snugly there against and snugly against the two immediately adjacent tubes 40 and their fins 42.

Figure 9:
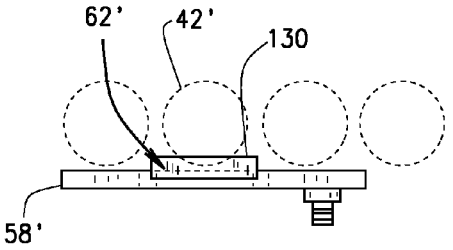
FIG. 9 is a top view of a modification featuring a rectangular interface plate mounted to a support plate, sans a grip member and baffle plate.
Figure 10:
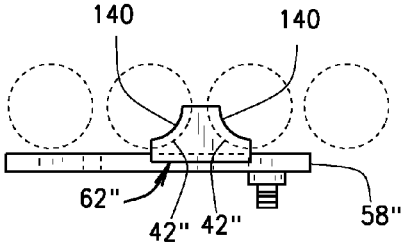
FIG. 10 is a top view of a support plate having a modified interface plate that engages two coil tubes.
Figure 16:
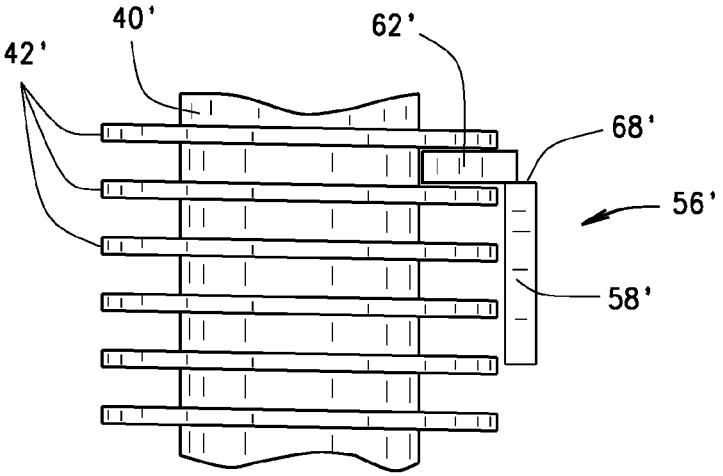
FIG. 16 is an elevated view of a coil tube and its fins, with the tube shown broken and with the support plate of the bracket to the right, with an interface plate of the type shown in FIG. 9 extending to be engaged between a pair of fins and resting on top of the fin beneath it.

Alternatives to the interface plate, or clip plate, 62 can be provided. One such alternative is shown in FIGS. 9 and 16 wherein the plate 58' has secured to its edge a rectangular interface plate 62'. The tightening of the plate 58' forces the outer edge 130 of interface plate 62' to press against a fin 42' to resist lateral and vertical movement of the plate 58' relative to the coil. FIG. 10 shows another modified interface plate 62" secured to a support plate 58". In this embodiment, the interface plate 62" has a general T-shape with two quarter-circular edges 140. Each of the edges 140 is pressed against a corresponding tube fin 42" when the plate 58" is tightened against the tubes. The FIG. 10 embodiment provides stability of bracing against two separate tubes and two separate fins. In both the FIG. 9 and FIG. 10 embodiments, the facing surface of plates 58' and 58" is in contact with the fins of each of three tubes which it faces.

Another alternative embodiment, which is believed to be the preferred embodiment, is shown in FIGS. 11-14. The arrangement in FIGS. 11-14 illustrates a baffle system A" having a mount structure 48" with a bracket 56". Bracket 56" has a generally flat support plate 58". Bracket 56" comprises a grip member 74". Grip member 74" comprises a distal grip member 200. Distal grip member 200 is depicted as a generally flat grip plate. Distal grip plate 200 has a pair of bores 202, as seen more clearly in FIG. 13. The discussion of the bracket 56''' is in the context of a row of tubes illustrated as including tubes 40W''', 40X''', 40Y''' and 40Z''' in FIG. 12.

Grip member 74''' also can comprise proximal grip members 208 and 209, illustrated in the preferred embodiment as bolts or studs. The distal ends of grip bolts 208 and 209 fit within their respective grip plate bores 202 and are held securely to grip plate 200, such as by fillet welding. The outside of the fillet weld can be ground smooth to be flush with the exterior surface 214 of distal grip plate 200. The grip bolts 208 and 209, and their respective grip plate bores 202, are spaced from each other so that bolts 208 and 209 extend generally parallel to one another, to rest against the outer surface of a tube 40X''', and against the outer fins of such tube if the the tube has fins such as fins 42X''' shown in FIG. 12. In such case, the tube 40X''' and fins 42X''' are gripped between the bolts 208 and 209.

Figure 12:
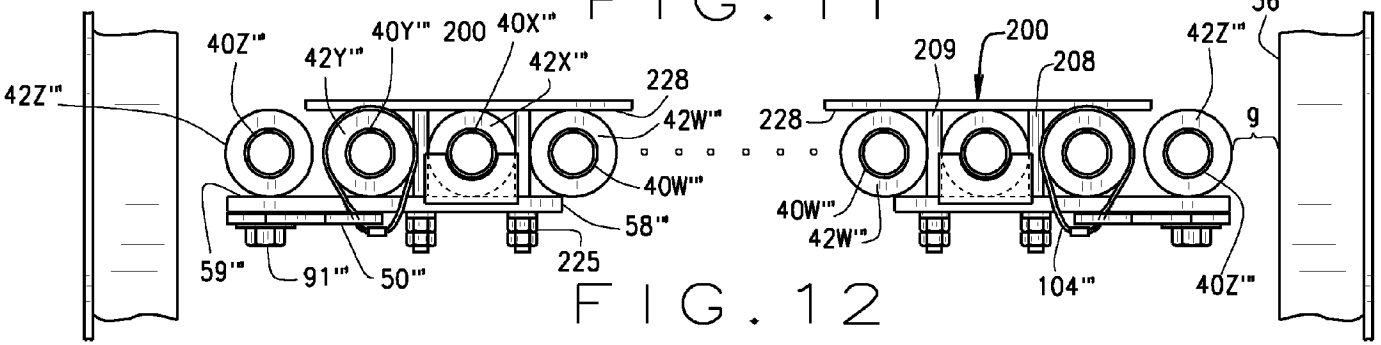
FIG. 12 is top view showing the modified assembly of FIG. 11, showing a pair of modified mounts secured relative to a heat exchange coil, and a baffle plate associated with each mount, with sidewalls of an HRSG shown broken and to the outside of each mount.

Additionally, the bolt 208 extends so that it also fits against the outer contours of the tube fins 42Y''' located to the exterior of the tube 40X''' and fins 42X''' in FIG. 12. Likewise, the grip bolt 209 extends between tube 40X''' and its fins 42X''' and the tube located to the interior thereof, 40W''' and its fins 42W''' as seen in FIG. 12, so that grip bolt 209 fits against the outer contours of tube fins 42W'''. Thus bolt 208 extends in a space located between tubes 40Y''' and 40X''', while bolt 209 extends in a space located between tubes 40W''' and 40X'''.

Figure 11:
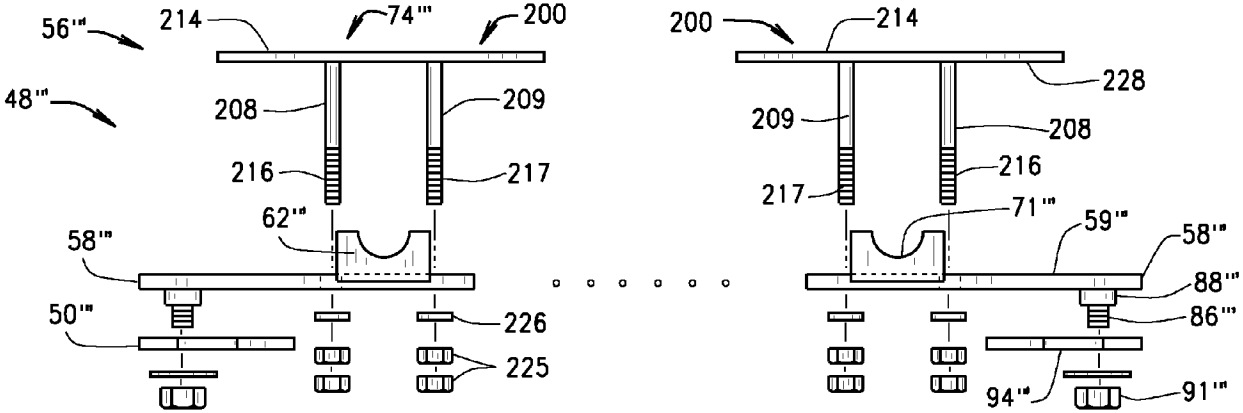
FIG. 11 shows exploded views of another modification of the assembly, with components of two modified mounts for attaching to a heat exchanger coil, and a baffle plate supported by each mount.
Figure 14:
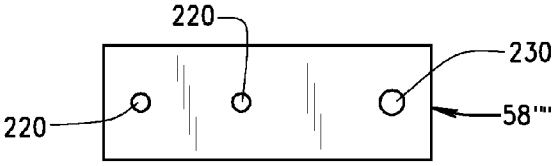
FIG. 14 is a side elevation of the modified bracket support plate of FIGS. 11 and 12.
Figure 13:
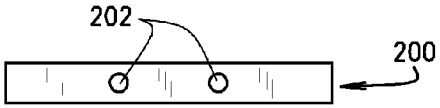
FIG. 13 is a side elevation of the grip plate of the grip member of the modification of FIGS. 11 and 12.

Each of the bolts 208 and 209 has proximal ends which are threaded at 216 and 217, respectively. As seen in FIG. 14, support plate 58''' has bores 220 which are aligned with the grip bolts 208 and 209, respectively, so that each of those bolts 208 and 209 extends there through. The threaded bolt ends 216 and 217 can be secured to the support plate 58''' such as by nuts 225 and washers 226, as illustrated in FIGS. 11 and 12. The snug fit of bolts 208 and 209 tin the space between tube 40Y''' and 40X''', and between tubes 40X''' and 40W''', with the pressure of plates 200 and 58''', thus applying an inwardly directed compressive force against tube 40X''' to stabilized against rotational movement of the mount 48''' relative to the coil 24.

An interface plate 62''' having a notch 71''', acts to engage a fin 42X''' as heretofore described. The engagement of interface plate 62''' with fin 42X acts to provide vertical support for bracket 58'''.

As with the embodiments of FIGS. 1-7, and FIG. 8, the support plate 58''' has a bore 230 that receives the enlarged proximal section 88''' of a pin 86'''. The pin 86''' is secured as by a washer and nut 91''' so that the enlarged section 88''' can slide in baffle slot 94'''.

When the assembly A''' and its mount 48''' and bracket 56''' are secured such as shown in FIG. 12, the interior surface 228 of grip plate 200 rests against the outside surfaces of the tube fins 42W''', 42X''', and 42Y''', or a first side of the row of tubes, to provide stability and rigidity for the mount 48'''. Such contact of plate 200 resists rotational movement of grip plate 200 and bolts 208 and 209, relative to the tubes 40X''', 40Y''' and 40Z''' and their respective fins 42X''', 42Y''' and 42Z'''. That contact thus resists such rotational movement of the entire mount 48''' and baffle plate 50''' relative to those tubes and fins, and thus relative to the entire arrangement of tubes 40''' in coil 24.

In the embodiment of FIGS. 11-14, the support plate 58''' is longer than that depicted in the embodiment of FIGS. 1-7 and in FIG. 8. In FIGS. 11-14 the length of support plate 58''' is such that the surface 59''' of support plate 58''' facing the tubes 40''', be in contact with the inside surfaces of fins 42W'''', 42X'''', 42Y'''' and 42Z'''', that is, of all four of the tubes illustrated in FIG. 12. The support plate 58'''' thus exerts force against the tubes 40W'''', 40X'''', 40Y'''' and 40Z'''' in a direction toward the distal grip member 200. Such engagement by support plate 58'''' against those four tubes, in combination with the gripping action of grip plate 200 against the fins 42W'''', 42X'''' and 42Y'''' of three tubes, the engagement of the bolts 208 and 209 against the tubes 40X'''', 40Y'''' and 40W'''', along with the vertical support of interface plate 62'''' against fin 42X'''', provide additional rigidity and resistance against rotation of the assembly A'''' and its mount 48'''', bracket 56'''', support plate 58'''' and baffle plate 50'''' relative to the tubes 40 of coil 24. The baffle plate 50'''' is held by a retainer tie 104'''' as heretofore described.

If desired, the grip member 200 can be longer than shown so as to contact more tubes and their fins, support plate 58'''' can be longer as well to engage more tubes and their fins, and more proximal grip members can be used to extend through additional spaces located between the tubes.

The assembly A'''' can be installed during the shop fabrication of the heat exchangers and coils 24 thereof. Components of the support plate 58'''', grip member 74'''' and baffle plate 50'''' can be mounted about various tubes within the coil 24 as the coil 24 is assembled, and more specifically in connection with the four tubes illustrated in FIG. 12, to be secured firmly and snuggly therewith. Such mounting can occur prior to the installation of the tubes 40 that would be positioned on the opposite side of the grip plate 200 from the side facing the tubes 40W'''', 40X'''', 40Y'''' and 40Z''''. Thus the assembly A, when so mounted, becomes integral with the arrangement of coils 24 to which the assembly A is secured.

Additionally, in the embodiments shown, the baffle plates are provided with the slot 94 to receive the pins 86 that are mounted to the plate 48 of bracket 46. However, though considered less desirable, the plate 48 could be provided with an oblique slot and the baffle plate 50 provided with a pin mounted thereto to be slidingly received within the bracket plate slot. With such a version, the baffle plate could likewise be held in a first position by a retainer so that when the retainer heat from the exhaust gas the force of gravity would move the baffle plate 50 downwardly and outwardly to an extended position so that the baffle plate outer edge 52 abutted the inner surface 54 of the sidewall liner 36.

With slight modification the baffle systems A may be used with coils having tubes oriented horizontally. Other types of heat-sensitive retainers, such as fusible links of the type used on fire doors, may be substituted for the ties 44, or even fusible stops can be used.

Changes can be made in the above constructions without departing from the scope of the disclosure, it is intended that all matter contained in the above description or shown in the accompanying drawings shall be interpreted as illustrative and not in a limiting sense.

The invention claimed is:

1. A casing and baffle system for a heat recovery steam generator, comprising:

the casing having a sidewall and heat exchanger coil located within the casing capable of exchanging heat from hot exhaust gas flow in the casing, with a gap between the end of the coil and the sidewall of the casing, a baffle system for closing the gap after the coil is installed in the casing, said baffle system comprising:

a mount attached to the coil at the gap; and a baffle plate connected in association with the mount to be movably supported by the mount, with the configuration of the mount and the configuration of the baffle plate being such that the baffle plate is positioned relative to the mount plate to be biased by gravity in a direction from a retracted position withdrawn from the sidewall to an extended position wherein the gap is closed.

2. The system according to claim 1 wherein the baffle plate abuts the sidewall in its extended position.

3. The system according to claim 1 wherein the mount has a support plate with a pin connected therewith, the baffle plate has a slot that extends at an oblique angle relative to the baffle plate, the slot being sized to receive at least a portion of the pin so that the pin portion is capable of sliding within the slot from the baffle's retracted position to the extended position.

4. The system according to claim 3 wherein the baffle system further comprises a temperature sensitive retainer for holding the baffle plate in its retracted position.

5. The system according to claim 4 wherein the temperature sensitive retainer has a composition capable of causing it to fail under the heat generated by the hot exhaust gas flow into the casing, so that upon failing the baffle plate can move by the bias of gravity from its retracted position to its extended position.

6. The system according to claim 1 wherein the configuration of the baffle plate and the configuration of the mount defines a pin and slot relationship between the baffle plate and the mount to be capable of allowing the pin to move relative to the slot as the baffle plate moves toward the extended position.

7. The system according to claim 5 wherein the mount has a support plate with a pin connected therewith, the baffle plate has a slot that extends at an oblique angle relative to the baffle plate, the slot being sized to receive at least a portion of the pin so that the pin portion is capable of sliding within the slot as the baffle plate moves from the retracted position to the extended position.

8. The system according to claim 7 wherein the coil has a plurality of tubes including a row having a plurality of tubes, and further comprising the support plate of the mount extending along a first side of the row of tubes to engage a plurality of tubes in the row of tubes, the support plate having a grip member connected therewith which grip member is positioned to extend along a second side of at least one tube in the row of tubes which second side is opposite the said first side, the grip member being positioned relative to the support plate to apply force against the tube in the direction of the support plate to allow the support plate to be mounted with the coil.

9. The system according to claim 7 wherein the coil has a plurality of tubes including a row having a plurality of tubes, and further comprising the support plate of the mount extending along a first side of the row of tubes to engage a plurality of tubes in the row of tubes, the support plate having a grip member connected therewith which grip member is positioned to extend along a second side of the row of tubes which second side is opposite the said first side, the grip member being positioned relative to the support plate to apply force against a plurality of tubes in the row of tubes in the direction of the support plate to allow the support plate to be mounted with the coil.

10. The system according to claim 9, wherein the grip member comprises a distal grip member positioned to extend along the second side of the row of tubes to engage at least three tubes in the row of tubes.

11. The system according to claim 10 in which the grip member further comprises a proximal grip member connected with the support plate and connected to the distal grip member, the proximal grip member extending between two tubes in the row of tubes.

12. The system according to claim 10 in which the grip member further comprises proximal grip members connected with the support plate and connected to the distal grip member, each proximal grip member extending between two tubes in the row of tubes.

13. The system according to claim 12 wherein a first proximal grip member extends between a space located between a first tube and a second tube in the row of tubes, and a second proximal grip member extends between a second space located between a third tube and the second tube, and wherein the first grip member and second grip member each engage the second tube.

14. The system according to claim 7 wherein the coil has a plurality of tubes, including a row having a plurality of tubes, and further comprising the support plate of the mount having a grip member connected therewith which grip member extends about and engages a tube in the row of tubes, the grip member being positioned to apply force against the tube in the direction of the support plate to allow the support plate to be mounted with the coil.

15. The system according to claim 14 in which the grip member is J shaped with a curved portion that curls around part of the engaged tube, the grip member having a proximal end that is connected to the support plate.

16. The system according to claim 14 in which the grip member is U shaped with a bite portion that curls around part of the engaged tube, the U shaped member having a pair of legs that each are connected to the support plate.

17. The system according to claim 8 further comprising a tube in the row of tubes having fins extending generally perpendicular to the tube and wherein the grip member engages the tube fins to grip the fins and tube to hold the fins and tube to the support plate, and further comprising the support plate having an interface plate connected to the support plate and extending in the direction of the engaged tube, with the interface plate fitting between two tube fins to support the tube and the coil.

* * * * *